US007559602B2

(12) United States Patent
Ward et al.

(10) Patent No.: US 7,559,602 B2
(45) Date of Patent: Jul. 14, 2009

(54) COOLER HAVING AN INTEGRATED SEAT

(76) Inventors: Jerry Ward, 1321 Ricon Rd., Escondidio, CA (US) 92025; Charles Barry Ward, 3615 Goldenrod Dr., Alpharetta, GA (US) 30005

( * ) Notice: Subject to any disclaimer, the term of this patent is extended or adjusted under 35 U.S.C. 154(b) by 273 days.

(21) Appl. No.: 11/285,209

(22) Filed: Nov. 23, 2005

(65) Prior Publication Data

US 2006/0278648 A1 Dec. 14, 2006

Related U.S. Application Data

(60) Provisional application No. 60/630,198, filed on Nov. 24, 2004.

(51) Int. Cl.
*A47C 7/62* (2006.01)

(52) U.S. Cl. ..... 297/188.04; 297/217.1

(58) Field of Classification Search ..... 297/217.1, 297/188.01, 188.04, 188.05, 188.06, 188.07
See application file for complete search history.

(56) References Cited

U.S. PATENT DOCUMENTS

| | | | | |
|---|---|---|---|---|
| 4,544,199 | A | 10/1985 | Wrigley | |
| 4,717,202 | A | 1/1988 | Batchelder, III | |
| 5,146,771 | A | 9/1992 | Loughlin | |
| 5,153,561 | A * | 10/1992 | Johnson | 340/571 |
| 5,588,631 | A | 12/1996 | Yee | |
| 5,727,844 | A * | 3/1998 | O'Quinn et al. | 297/217.1 |
| 5,779,112 | A * | 7/1998 | Krulik | 224/155 |
| 6,076,298 | A * | 6/2000 | Teel | 43/54.1 |
| 6,116,676 | A * | 9/2000 | Edwards | 296/64 |
| 6,196,437 | B1 * | 3/2001 | Smith, III | 224/629 |
| 6,364,391 | B1 * | 4/2002 | Everett | 296/51 |
| 6,471,019 | B1 * | 10/2002 | Miller | 190/11 |
| 6,510,717 | B1 | 1/2003 | Levi | |
| 6,588,822 | B1 * | 7/2003 | Duvall, Jr. | 296/57.1 |
| 6,739,652 | B2 * | 5/2004 | Welsh | 297/129 |
| 6,824,186 | B2 | 11/2004 | Brown | |
| 6,932,427 | B2 * | 8/2005 | Tamura | 297/217.1 |
| 7,163,262 | B2 * | 1/2007 | Anglin | 297/217.1 |
| 7,201,424 | B1 * | 4/2007 | Fournier | 296/57.1 |
| 7,213,692 | B2 * | 5/2007 | Wang et al. | 190/8 |
| 2004/0200400 | A1 | 10/2004 | Huse | |
| 2005/0035119 | A1 * | 2/2005 | Hull et al. | 220/23.87 |

* cited by examiner

*Primary Examiner*—Sarah B McPartlin

(57) ABSTRACT

A cooler having an integrated seat assembly, includes a cooler body which can have one or more compartments. The cooler body is coupled with a seat assembly bracket by a coupling means, such as a hinge. Seat backs are integrally formed in one sidewall of the cooler body and seat bottoms are formed on the bracket, such that when the bracket is opened, it forms a seat with the seat backs. The bracket can be folded up flat against the cooler in a closed and locked position, for easy storage or transportation.

26 Claims, 19 Drawing Sheets

COOLER HAVING AN INTEGRATED SEAT

CROSS-REFERENCE TO RELATED APPLICATIONS

This application claims the benefit of priority to U.S. Provisional Patent Application No. 60/630,198, filed on Nov. 24, 2004, the contents of which are incorporated herein by reference.

BACKGROUND OF THE INVENTION

1. Field of the Invention

The present invention relates to coolers. More particularly, the present invention relates to coolers having seat attachments and the like, for use while tail gating, camping, fishing, etc.

2. Description of the Related Art

Coolers are essential items for many recreational activities, such as, camping, fishing, picnicking and "tailgating." An innovative cooler having a seat attachment is disclosed in the co-owned, U.S. patent application Ser. No. 10/672,802, which was filed on Sep. 26, 2003, the entire contents of which are hereby incorporated by reference. The cooler with the seat attachment is useful for many activities and is also a space saving device. However, the seat attachment disclosed in the '802 patent is bulky and uncomfortable.

There is a need for an improved cooler having a seat attached thereto that is more comfortable to use and which takes up less space.

SUMMARY OF THE INVENTION

The present invention includes a cooler having an integrated seat assembly. The cooler includes a cooler body (e.g., insulated cooler), which can have one or more compartments. The cooler body is rotatably coupled with a seat assembly bracket by a coupling means, such as a hinge. Seat backs are integrally formed in one sidewall of the cooler body (having seatbacks formed thereon) and seat bottoms are formed on the bracket, such that when the bracket is opened, it forms a seat with the seat backs. The seat assembly bracket may be closed flat with the adjacent surface of the cooler body and secured in the closed position for easy carrying or storage.

Armrests can be provide which fold into slots or compartments of the bracket and which can also couple the cooler body with the bracket to strengthen the cooler seat in the open position for use. The arm rests can include cup holders.

The cooler body can also include lockable storage and an umbrella holder.

The cooler body bottom surface can include an offset surface portion forming an obtuse angle with the bottom, such that the cooler body, when resting on the offset surface, forms an obtuse angle with the bracket in the open position. As a result, the seat backs are reclined.

The seat bottoms can be formed in the bracket and can be padded. Retractable footrests can be provided in the bracket as well.

All parts can be molded fiberglass, steel or formed from other appropriate materials.

Further applications and advantages of various embodiments of the present invention are discussed below with reference to the drawing figures.

DETAILED DESCRIPTION OF THE PREFERRED EMBODIMENTS

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

Figure 1:
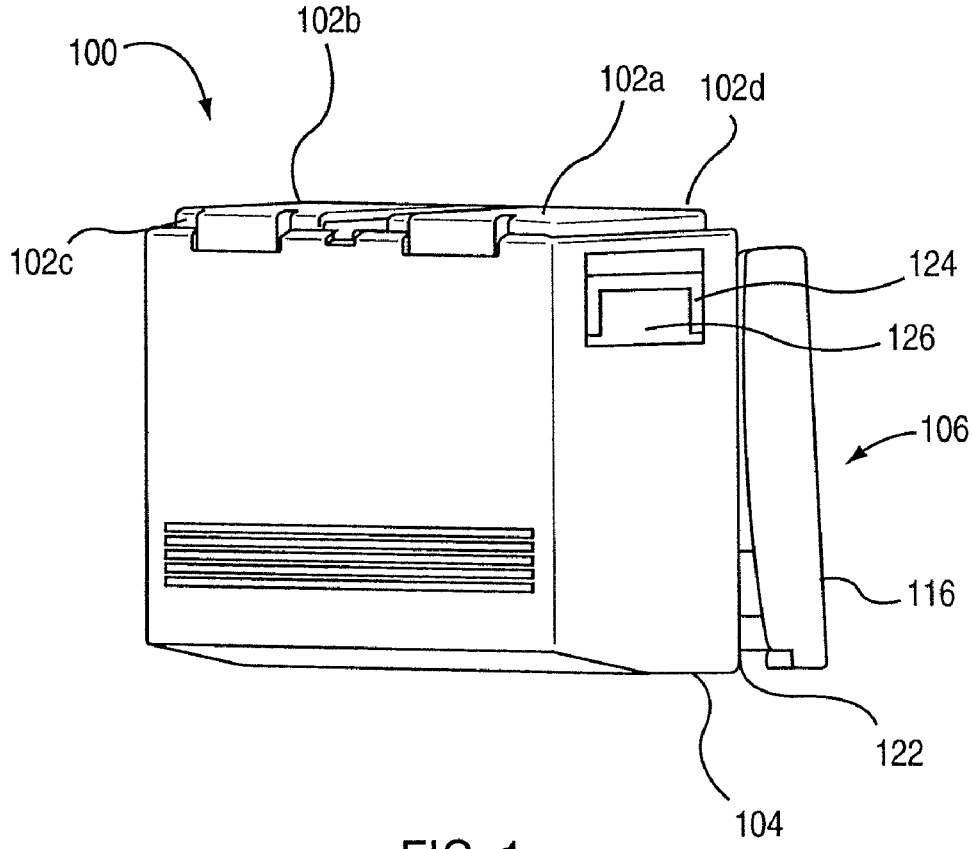
FIG. 1 illustrates a cooler having an integrated seat in the closed position.

According to an embodiment of the present invention, a cooler having an integrated seat (hereinafter referred to as "cooler seat") is shown in FIG. 1. Cooler seat 100 includes a cooler body 104 with an integrated seat assembly 106 coupled to the cooler body 104 via a hinge 122. The interior of the cooler body 104 can be accessed by means such as lid, hatch, door or other cover.

Cooler body 104 may include any number of storage compartments, but preferably includes two insulated interior compartments having compartment lids 102*a* and 102*b* providing access thereto. As shown, the lids 102*a*, 102*b* can be form fitted and include integral hinges 102*c* and 102*d*. The compartments may be removable or permanent. Cooler body 104 can include means for carrying the cooler such as handles 124. Each cooler compartment can also include its own carrying means, such as handles (not shown). In the case of portable cooler compartments, a securing means may be provided for securing the portable compartment to the cooler body when it is inserted therein. Such securing means can be lockable.

As shown, the handles can be formed in a small cut-out section 126 to allow them to be folded in and out of the way. One having ordinary skill in the art will readily understand that a number of ways for providing access to the interior of the cooler body 104 could be contemplated as well as the number of different configurations for carrying the cooler.

Figure 2:
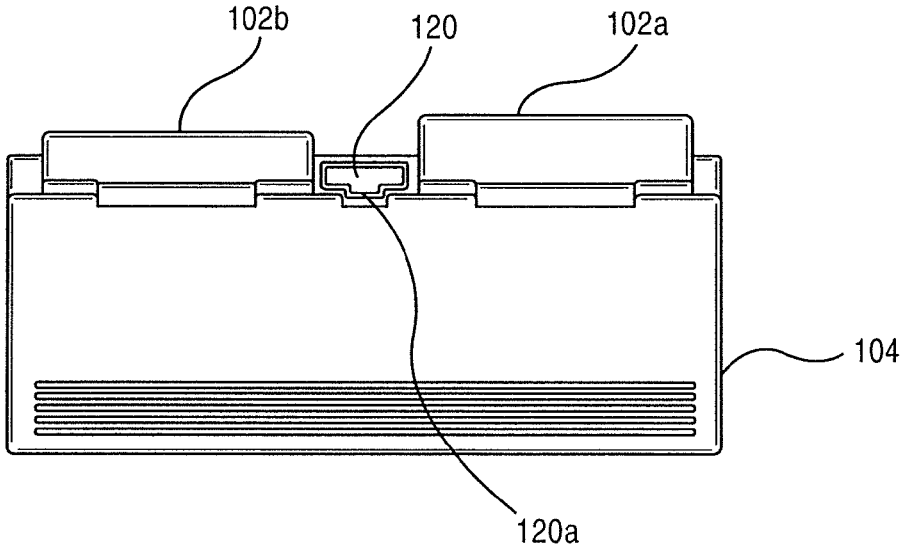
FIG. 2 is a rear perspective view of the cooler seat.

FIG. 2 is a rear perspective view of the cooler seat. As shown, the cooler seat 100 could include a third compartment accessed via lid 120. This compartment could be used for holding small items or accessories. The compartment can be physically separate from the compartments accessed by lids 102*b* and 102*a*. Drains (not shown) can be provided for any or all of the compartments. Portable compartments could be provided their own drains. Lid 120 can also include a molded hinge 120*a* similar to the molded hinges 102*c, d*.

Figure 3:
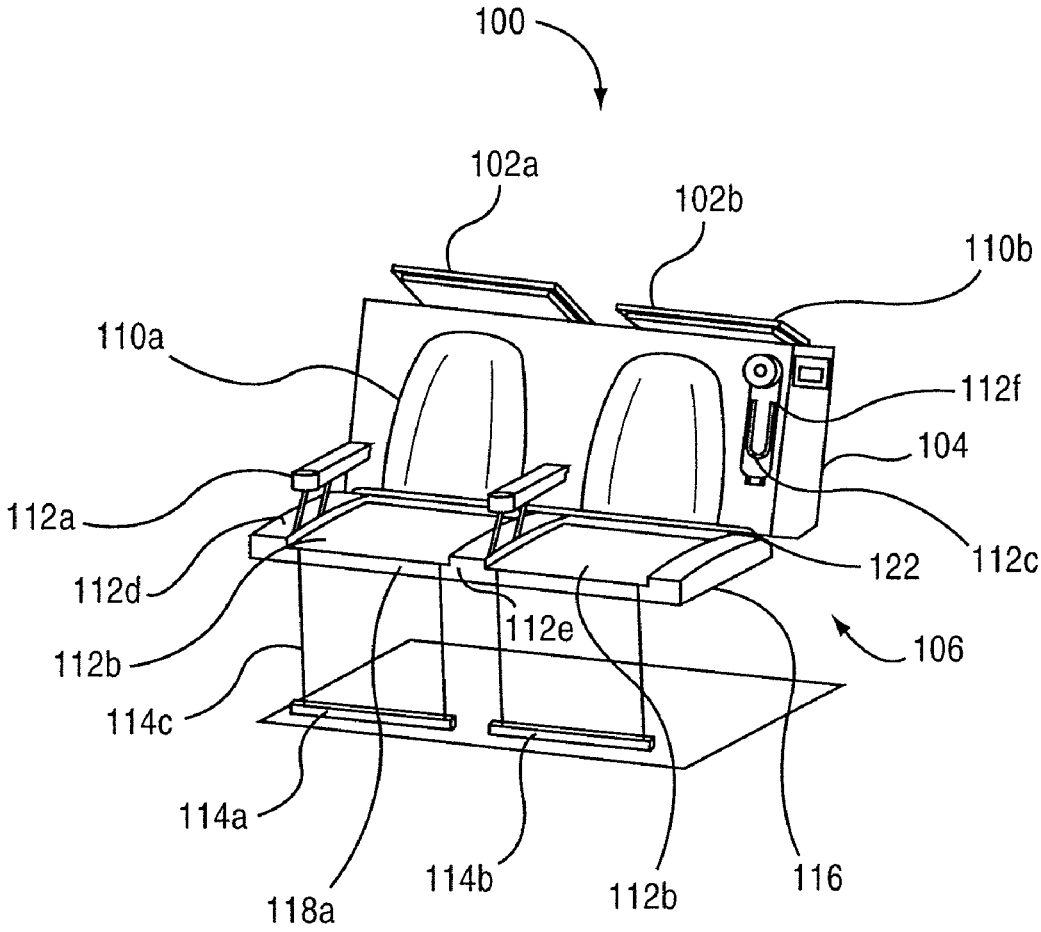
FIG. 3 shows a perspective view of the cooler seat fully opened.

FIG. 3 shows a perspective view of the cooler seat 100 in the fully opened position according to an embodiment of the present invention. Seat assembly 106 includes a bracket or frame 116 coupled with the cooler body 104 via hinge 122. The bracket 116 holds or includes seat bottoms 118*a* and 118*b*, which may be molded, foam padded, or the like. Seat bottoms 118*a* and 118*b* can be formed in indentation in the bracket 116. One skilled in the art should understand that, although the seat assembly is described as including a frame and seat bottoms, the assembly may be a solid piece or multiple pieces.

Armrests 112*a*, 112*b* and 112*c* can be coupled with the cooler body 104 via a hinge or the like and can collapse into indentations or slots in the bracket 116 when the bracket 116 is folded up into its closed position. Support elements 112*d*, 112*e* and 112*f* can also be provided. Support elements may be formed with the armrests 112 and fold out to connect with the bracket 116, such as to a fitting provided in the bracket 116. Alternatively, the armrests 112 could be provided in the bracket 116 and could pop-up.

Preferably, the armrests 112 would be coupled with the body 104 when the cooler seat 100 is used to provide structural strength. Leg rests (or foot rests) 114*a* and 114*b* are connected to the bracket 116 via connecting means 114*c*. The connecting means 114*c* could be steel wire, nylon tethers or other connecting means that can provide support for a cooler seat user's feet while in the sitting position. Preferably, the foot rests 114*a* and 114*b* can be retracted easily and out of the way. The connecting means 114*c* are preferably connected through a hole in the chassis. Seat backs 110*a* and 110*b* can be molded or contoured directly into the cooler body 104, and can include seat back cushions.

The depth of the indentations for the seat bottoms 118*a* and 118*b* formed in the bracket 116 could be adjusted to accommodate the seat backs 110*a* and 110*b* when in the folded position, such that the bracket 116 will fold flat against the cooler body 104.

Figure 4:
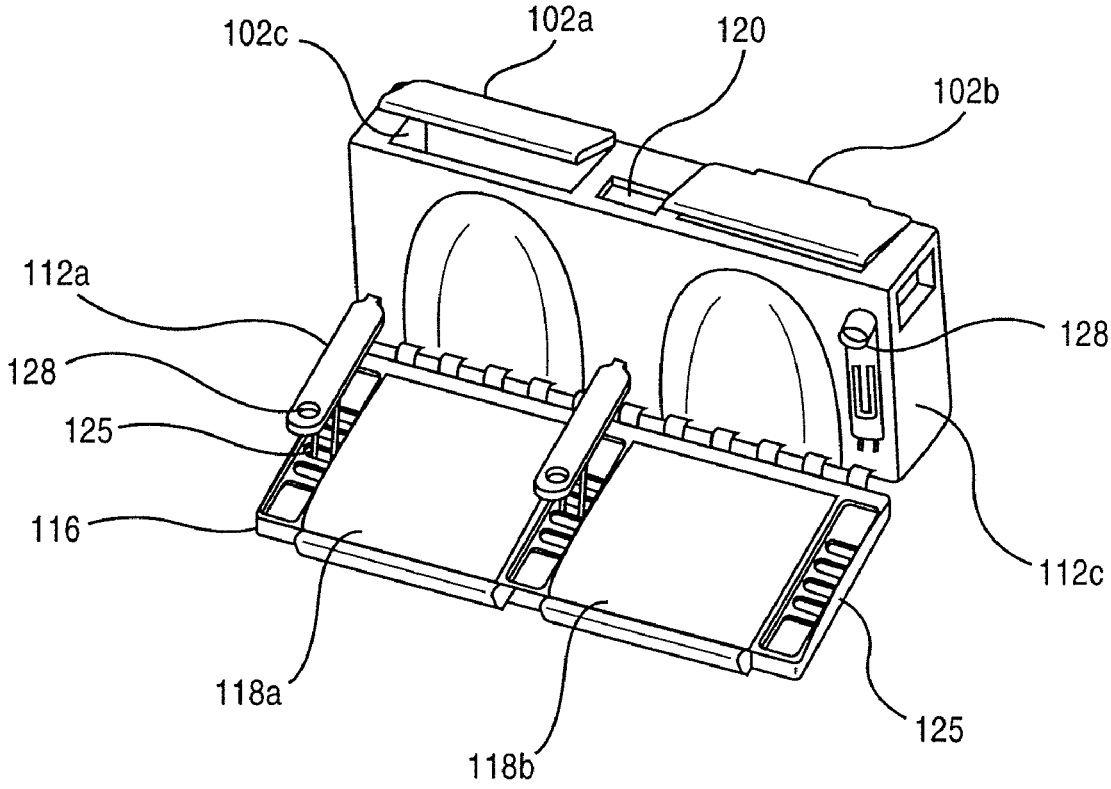
FIG. 4 is another perspective view of the cooler seat in the open position.

FIG. 4 is another perspective view of the cooler seat 100 in the open position. As shown, the indentations in the bracket 116 for accommodating the armrests 112 can include slots 125 which allow the adjustment of the height of the armrests. The slots 125 can be of such number and size to allow a range of adjustability for the armrests. As can be seen, each armrest can also include a fishing rod holder 128 and a retractable cup holder 130 (clearer in FIG. 5). The cup holder 130 can be similar to a retractable cup holder found in an automobile. Also, the interior insulated compartments 102*c* can be seen in this view. As discussed herein, these interior compartments may be integral with the cooler body 104 or may be removable.

Figure 5:
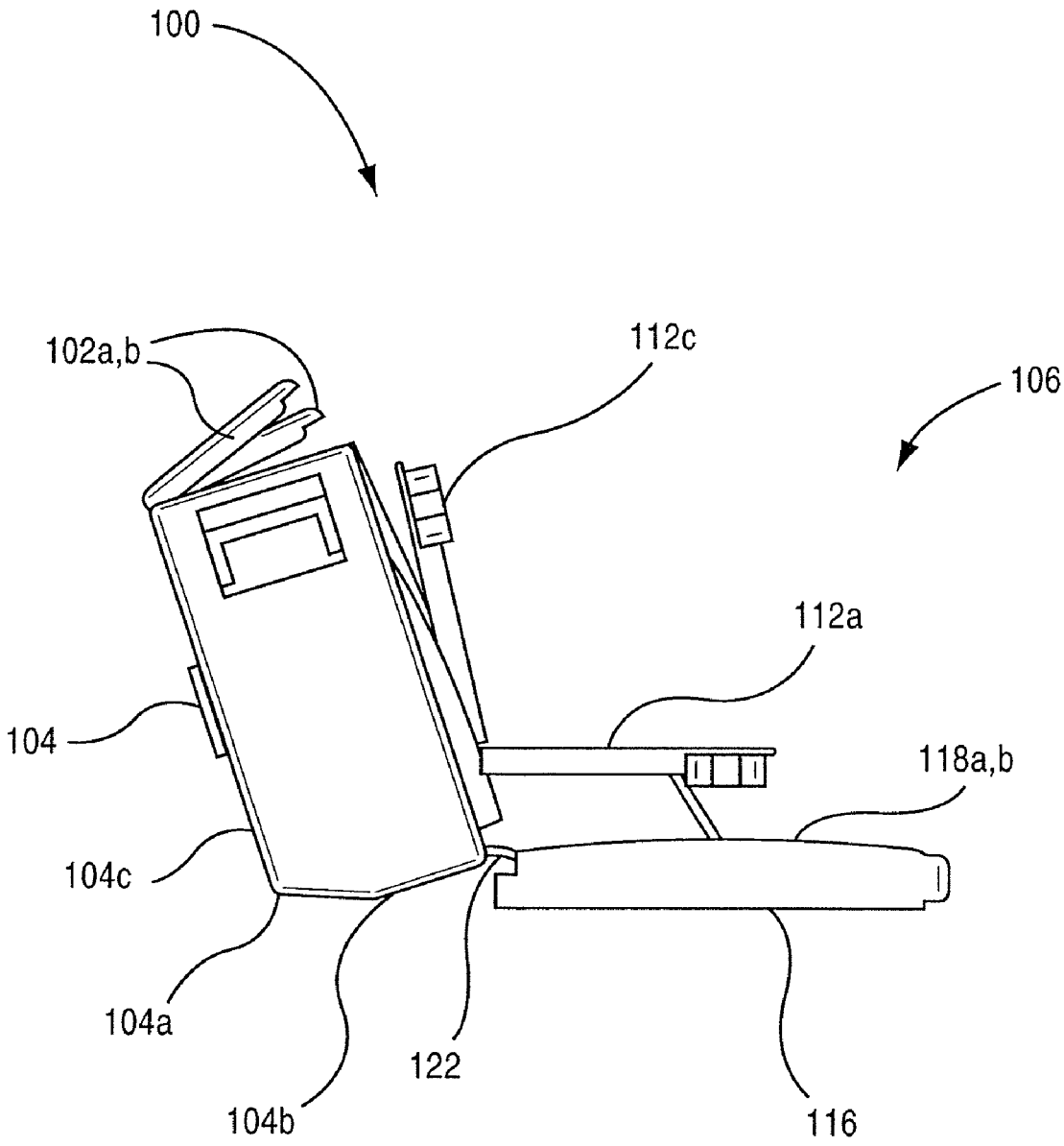
FIG. 5 is a side view of the cooler seat in the opened position.

FIG. 5 is a side view of the cooler seat 100 in the open position. As shown from the side view, the bottom of cooler body 104 can have a flat portion 104*b* that is generally perpendicular to the side walls of the cooler body, and an angle portion (offset portion) 104*a* formed by obtuse angle with the back wall 104*c* of the cooler body 104. As such, the angle part 104*a* can rest on a flat surface, such as the bed of a pickup truck, allowing the cooler body 104 to be at an obtuse angle with the bracket 116. By providing the angle part 104*a*, a user of the cooler seat can be seated in a comfortable, semi-reclined position rather than a pure upright position. Further, in this semi-reclined position, cooler seat 100 is very stable.

In a preferred use, cooler seat 100 is intended to be positioned over the hinge of a tailgate on a pick-up truck or an SUV and opened. The hinge 122 of cooler seat 100 would generally be positioned directly over the hinge between the tailgate and the vehicle, while the cooler body 104 would rest in the vehicle (e.g., on the bed of a pick-up, or in the cargo area of an SUV) and the bracket 116 would rest on the tailgate. A stabilizing means or locking mechanism connects the cooler seat 100 to the vehicle, preferably to the hinge of the tailgate of the vehicle. This stabilizing means can be in the form of a fastener, such as a tether, bungee cord or the like. Thereby, one can easily see that the cooler seat can provide a safe, sturdy and comfortable seat in the back of a vehicle where a seat normally is not provided.

Other fastening devices are contemplated. For example, many station wagons and SUVs employ tie-down latches and might not have a traditional tailgate. In such a circumstance, bungee cords or the like could be used to attach the cooler seat to the tie-down latches, such as from the handles of the cooler seat. Further, tie-down latches or clips could be provided on the cooler seat body 104.

Figure 6:
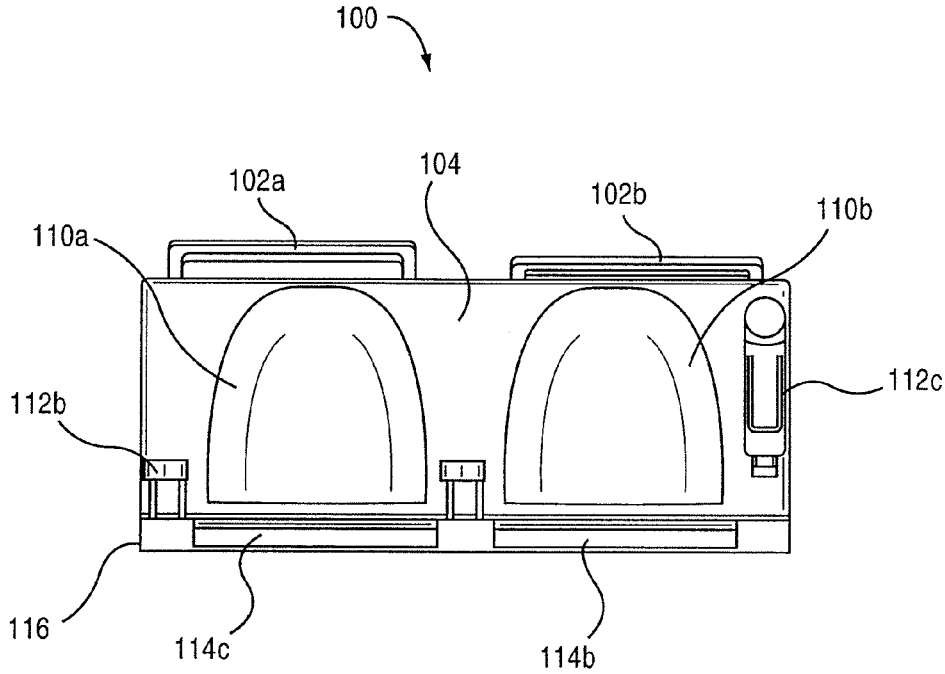
FIG. 6 is a front view of the cooler seat in the opened position.

FIG. 6 is a front view of the cooler seat 100. As shown, seat backs 110*a* and 110*b* may be contoured and molded in the cooler body 104. The cooler lids 102*a* and 102*b* can be designed to open from the seat side of the cooler, to allow easy access to a seated person. Foot rests 118*a* and 118*b* in their retracted position are visible.

Figure 7:
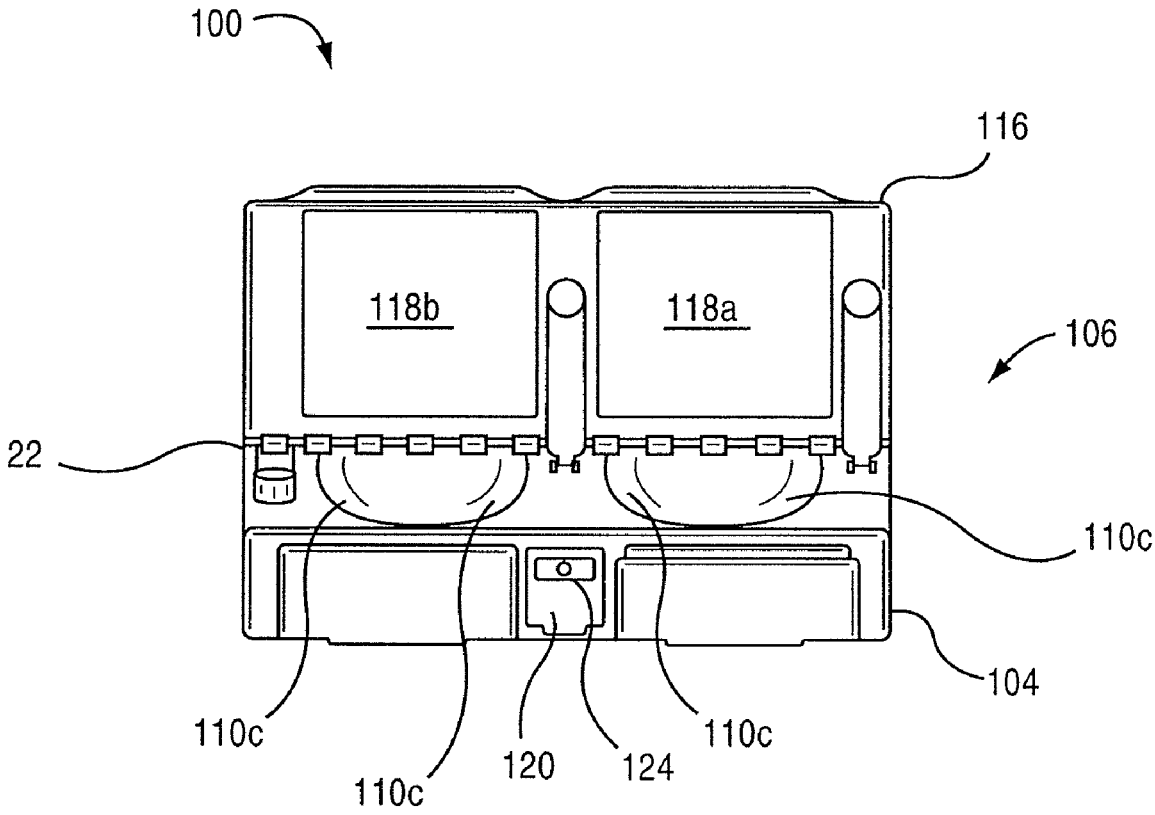
FIG. 7 is a top view of the cooler seat in the opened position.

FIG. 7 is a top view of the cooler seat in its an expanded or opened configuration. As can be seen in this view, side bolsters 110*c* can be provided in the seat backs 110*a* and 110*b*. Also, the cooler body 104 is at an angle greater than 909 with the bracket 116 when resting on the offset portion of the bottom surface, thereby allowing a person to sit in a comfortably semi-reclined position.

Further, hinge 122 is clear in this view. Preferably, as shown, the hinge parts are molded respectively in the bracket 116 and the cooler body 104 and can be joined with a pin (not shown). An umbrella holder 124 is positioned towards the seat in between the cooler compartments and in front of the accessory compartment 120. The umbrella holder 124 can simply be a hole or a tube, such as a PVC tube into which an umbrella pole can be inserted, and can be on an angle in order to better secure an umbrella.

Figure 8:
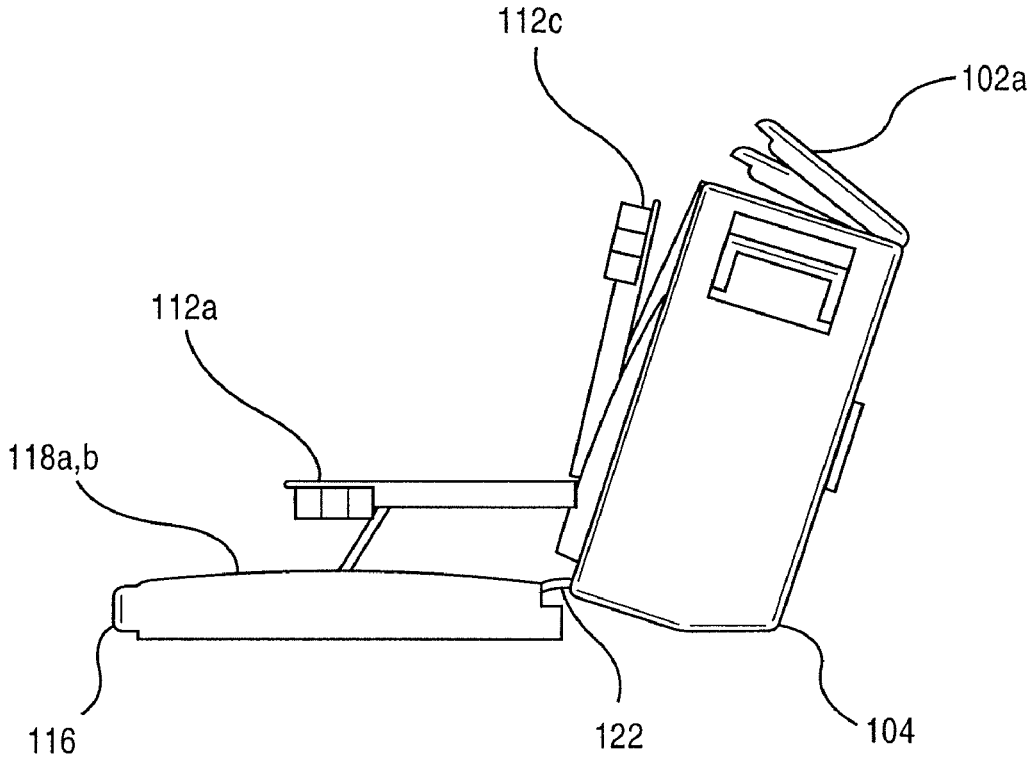
FIG. 8 is another side view of the cooler seat in the opened position.

FIG. 8 is another side view of the cooler seat 100. In this view, the cooler seat 100 is in its normal open configuration.

Figure 9:
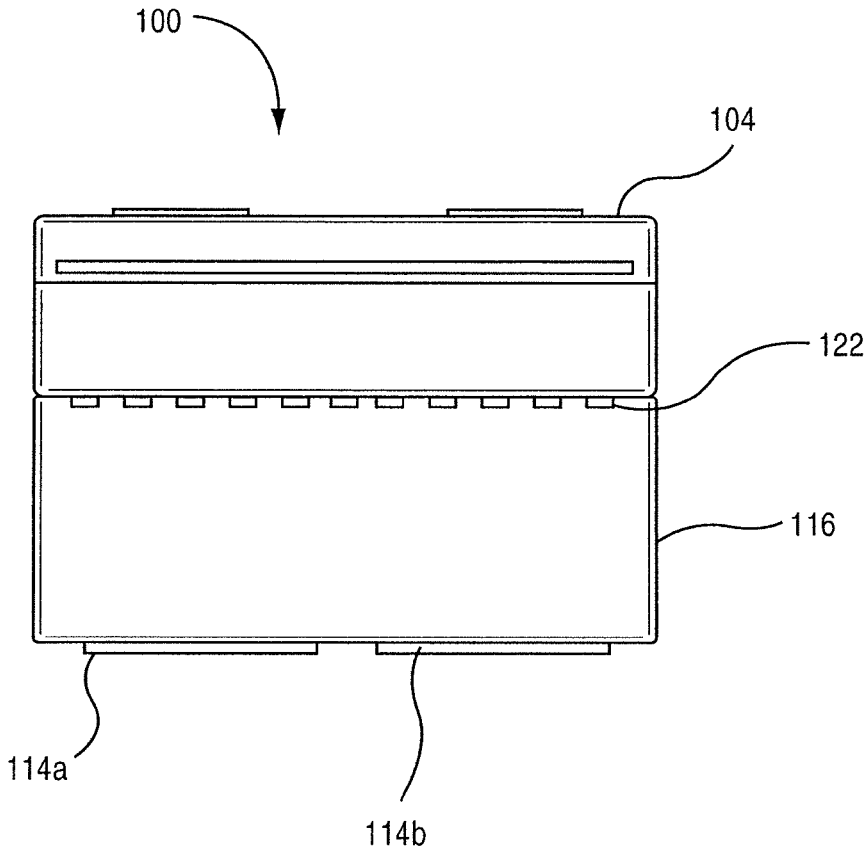
FIG. 9 is a bottom view of the cooler seat in the opened position.

FIG. 9 is a bottom view of the cooler seat 100.

Figure 10:
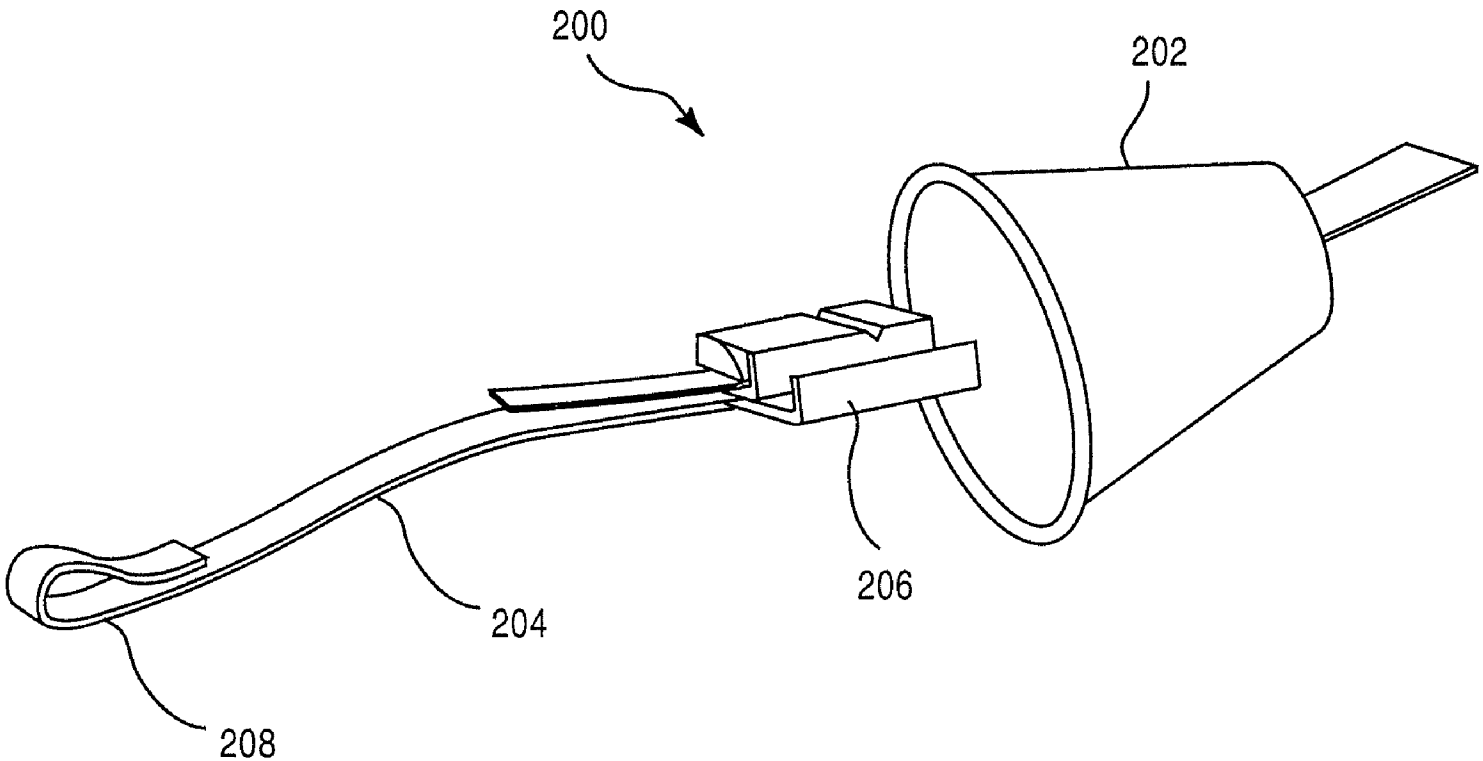
FIG. 10 is a perspective view of a locking mechanism for the cooler seat.

FIG. 10 is a view of a locking mechanism according to an embodiment of the present invention. The locking mechanism 200 may include cone or saucer shaped device 202 that is cinched via a strap 204 and can have a buckle 206 in the open end that is surrounded by the cone to prevent any damage thereto. The cone 202 can be made of a soft material, rubber, soft plastic etc., and when pulled tight, secures the cooler seat, and the cone 202 hides the buckle 206. A lock (not shown), such as a conventional key or combination lock, can be secured to the open loop 208 in the strap, and when locked serves as an anti theft device.

That is, the strap can be attached or wrapped around the hinge of the cooler seat and also down around the hinge of the tailgate of the vehicle on which it is being secured. A lock is locked to the open end 208 of the strap and the other side of the strap, through the buckle 206, is pulled tight until the cone 202 is snug against the opening between the tailgate and the vehicle, covering the buckle. Therefore, the buckle 206 cannot be accessed and the strap cannot be loosened to remove the cooler seat until the padlock is removed. When the device is snugged-up tight, it is not noticeable and the lock is only accessible from below the tailgate. For convenience, an electric lock, possibly with remote control, could be provided.

In an embodiment of the present invention, the cooler seat may be equipped with a number of additional features. For example, the cooler handles can fold in flat and out of the way.

The center storage compartment can be provided with a lock, so as to provide lockable storage for valuable belongings. Two straps can be provided for locking or securing the cooler seat to the truck. The seat backs of the cooler seat can be provided with side bolsters which provide comfort and support.

Further, external or internal electric heating and/or cooling units (chiller units) could be provided. As such, space could be allotted inside the cooler body to accommodate heating and/or cooling units, while appropriate conduits for electric wiring, ventilation, drainage, etc. could be provide as will be understood by those in the art. Such units could be powered by DC voltage. An electrical connection (not shown) could be provided from the cooler to a vehicle DC cigarette lighter type receptacles or to a vehicle's DC terminal (e.g., 4-prong) next to the trailer hitch for connected power to a trailer, or to other DC sources, such as tail lights.

The body of the cooler can be metal, such as stainless steel, or can be molded or high impact plastic, fiberglass or the like, or be manufactured from another material or composite (e.g., metal embedded in plastic or fiberglass). Preferably, the seat assembly is provided with a steel chassis, but could also be manufactured from other suitable materials.

Figure 11A:
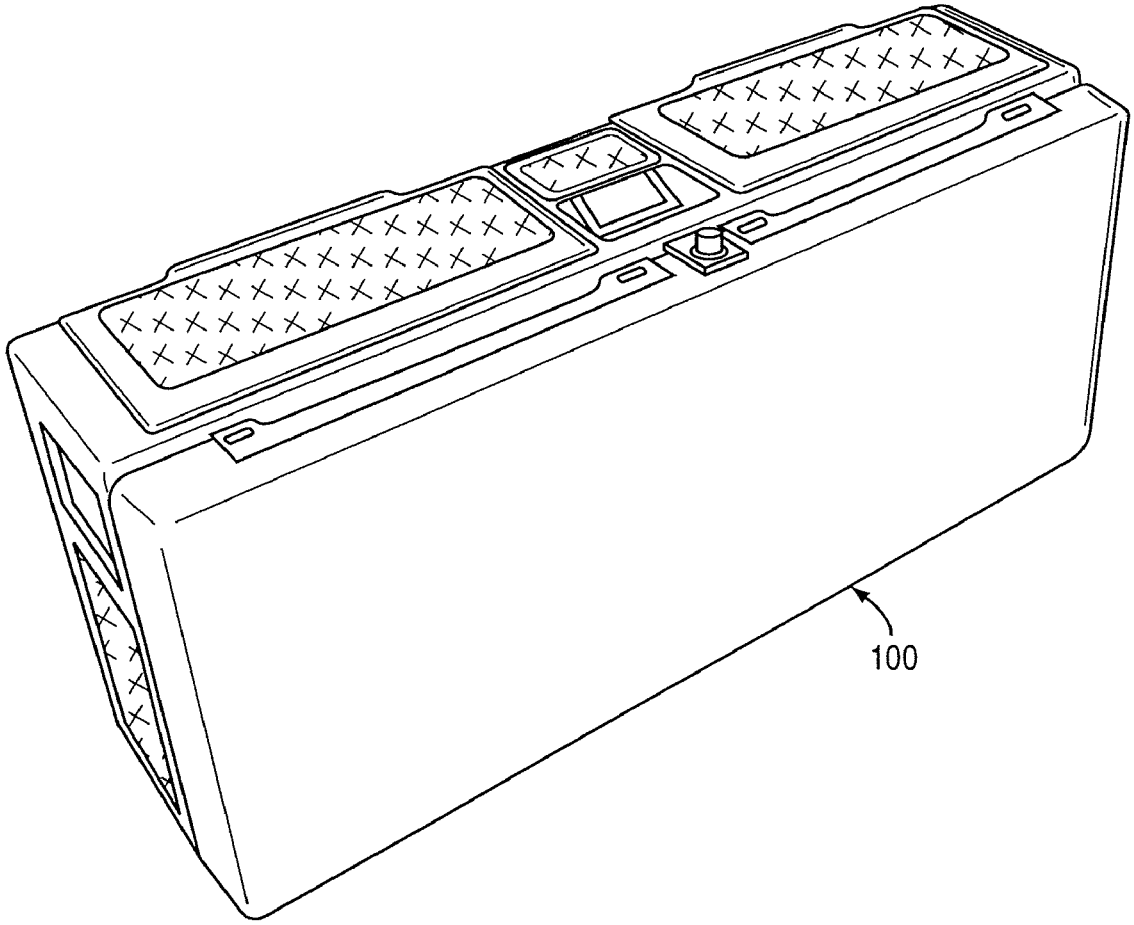
FIGS. 11*a-i* show various views of the cooler seat in the opened and closed positions according to another embodiment of the present invention.
Figure 11B:
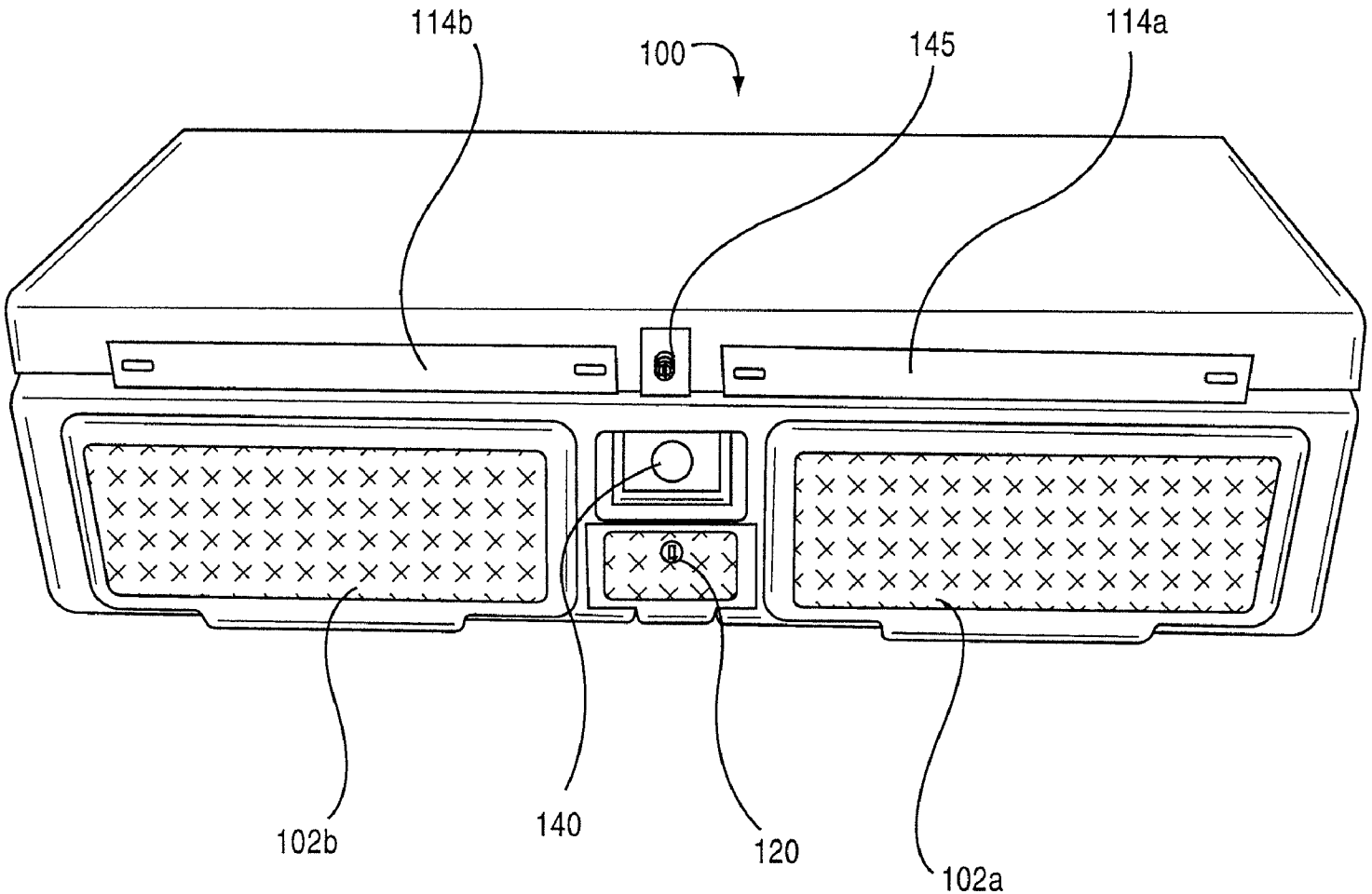
Figure 11C:
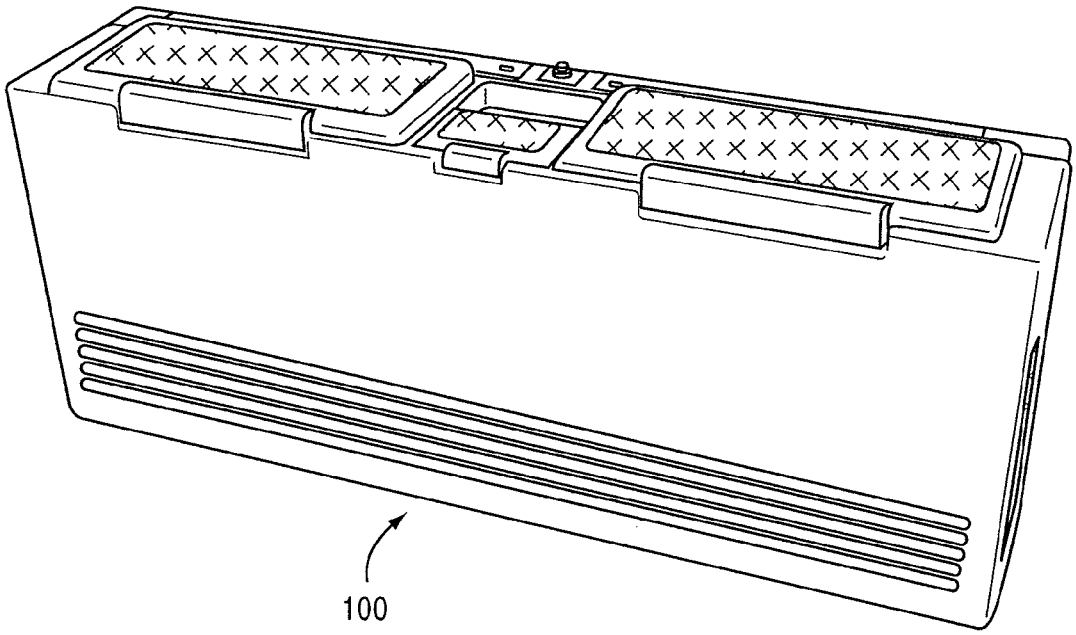

FIGS. 11*a-i* show various views of a cooler seat according to another embodiment of the present invention. FIG. 11*a* shows the cooler seat 100 in the folded (closed) and locked position. FIG. 11*b* is a top view of the cooler seat 100, which shows two cooling compartment lids 102*a, b*, lockable compartment 120, an umbrella holder 140, the retracted footrests 114*a, b*, and the seat lock 145. FIG. 11*c* is another view of the cooler seat 100 in the locked position.

Figure 11D:
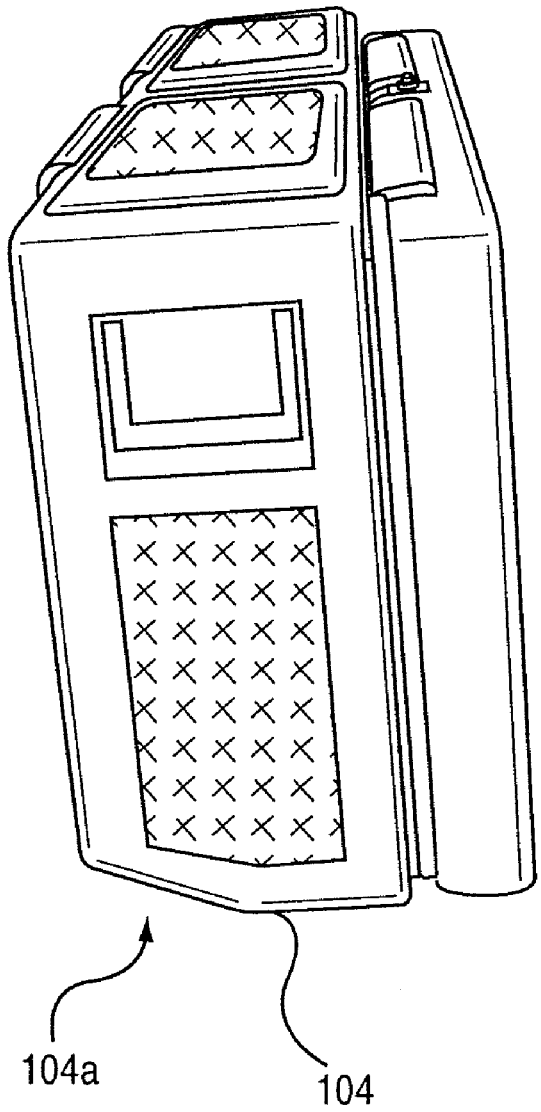
Figure 11E:
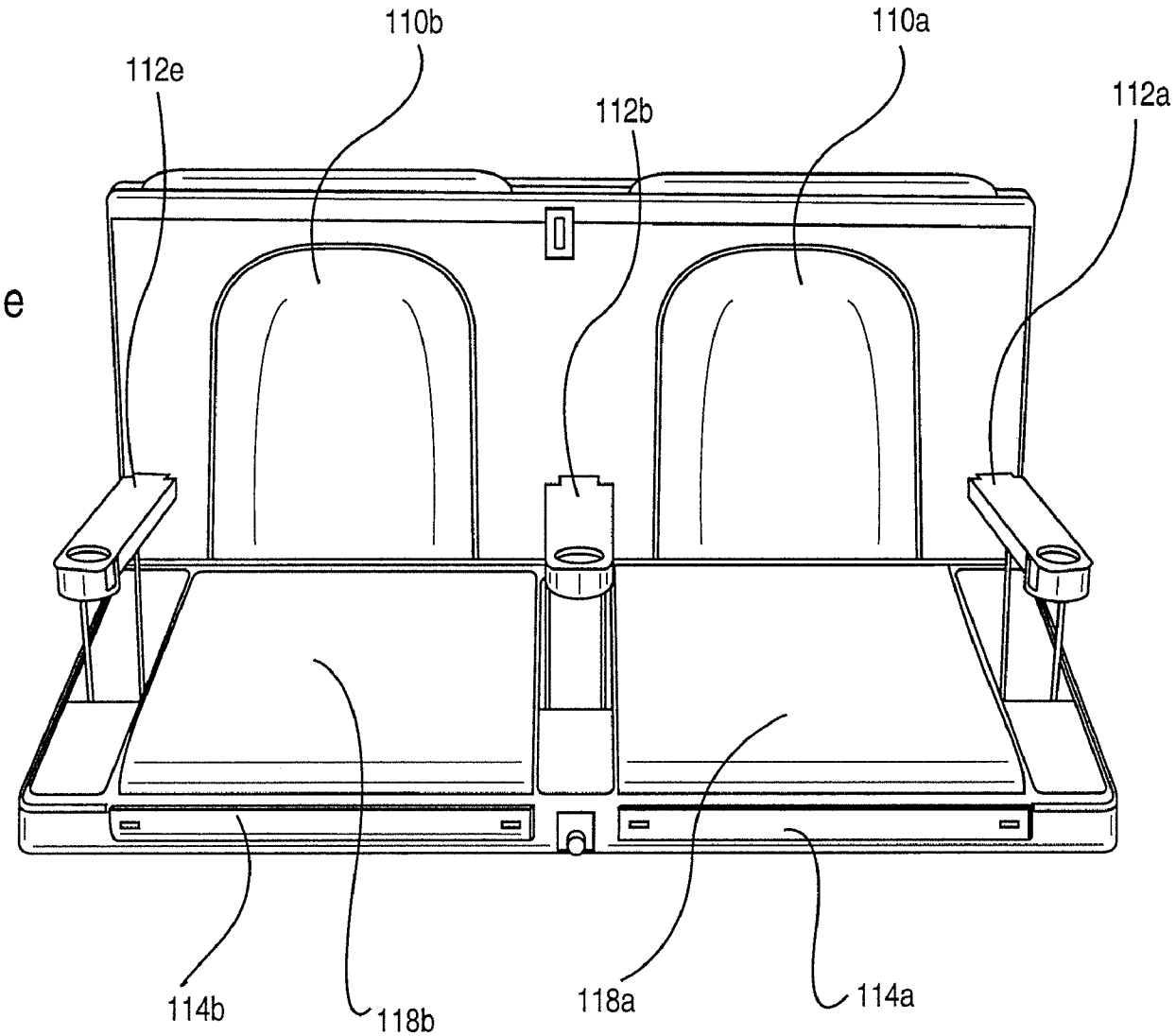

FIG. 11*d* is a side view of the cooler seat 100, which shows the offset portion 104*a* of the cooler seat bottom 104. FIG. 11*e* shows the cooler seat 100 in the opened (seating) position. Shown are the seatbacks 110*a, b*, seat bottoms 118*a, b*, arm rests 112*a-c*.

Figure 11F:
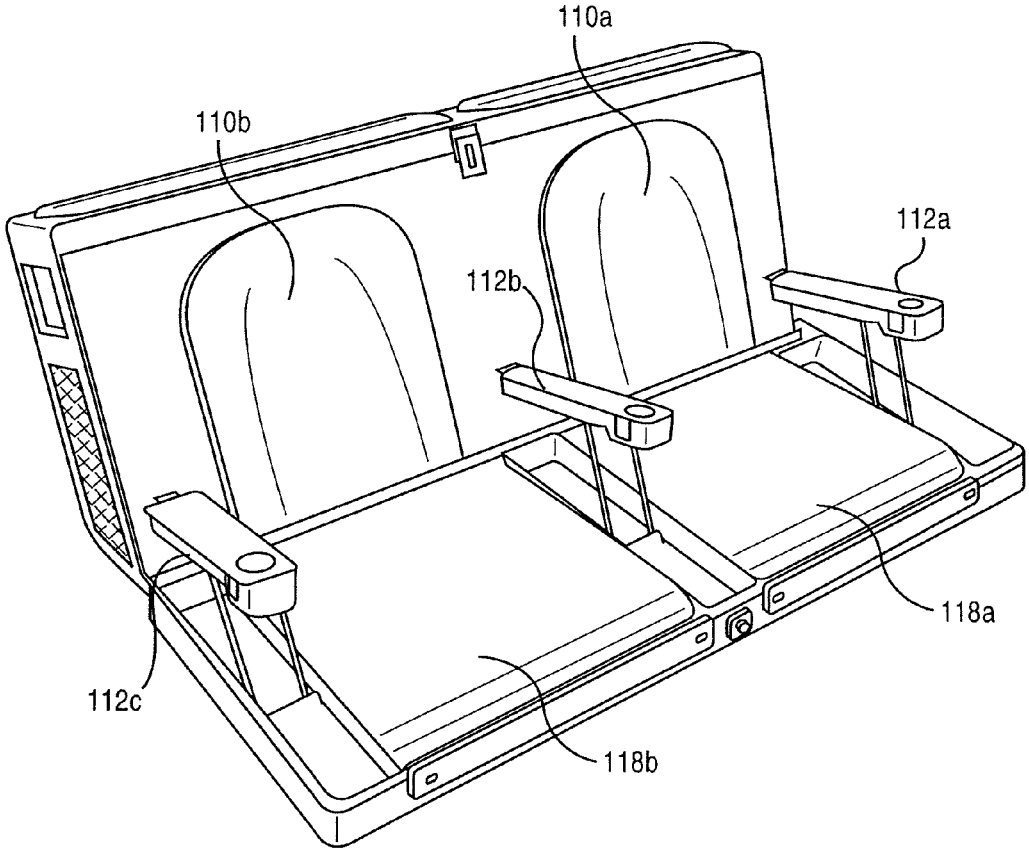
Figure 11G:
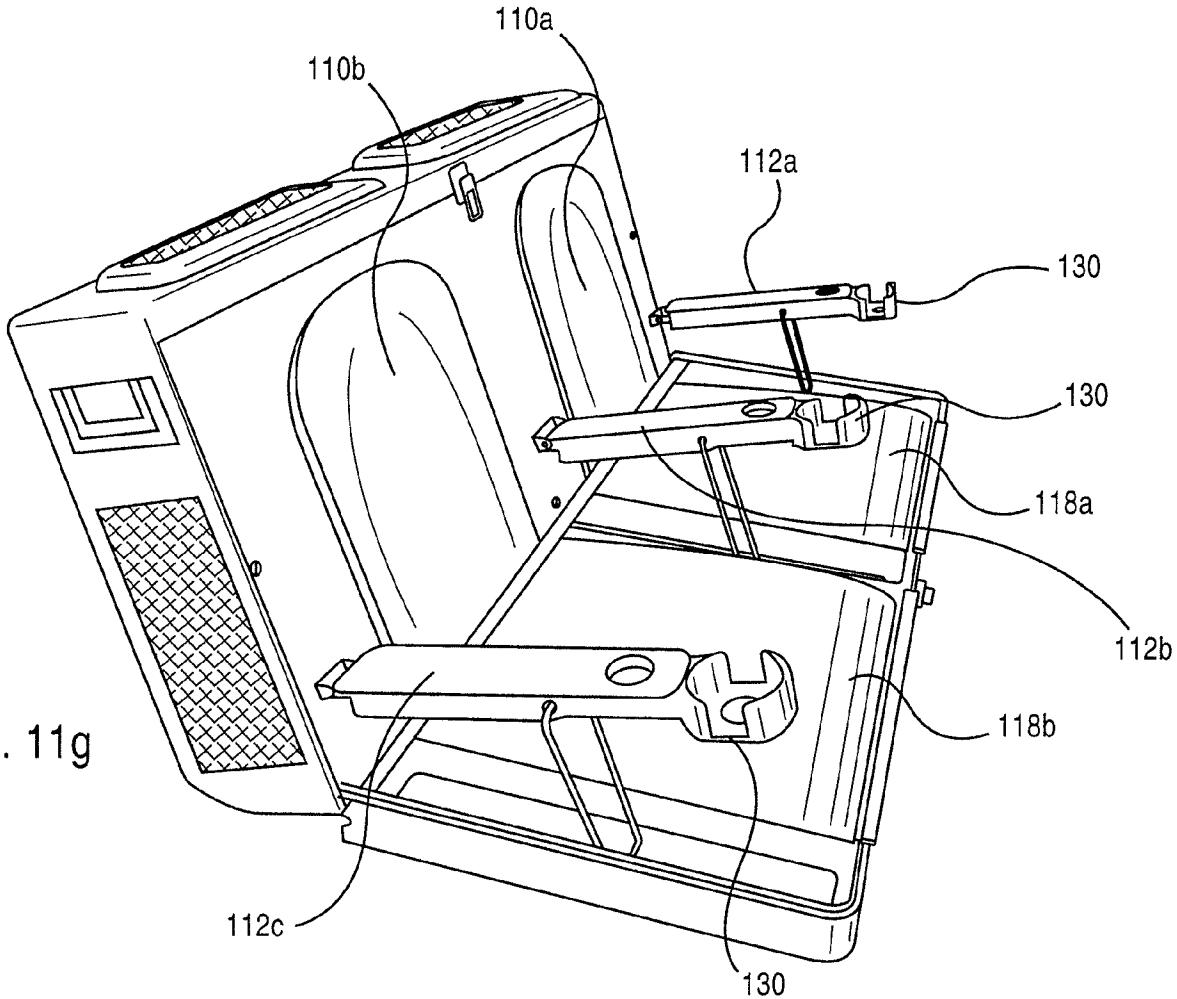
Figure 11H:
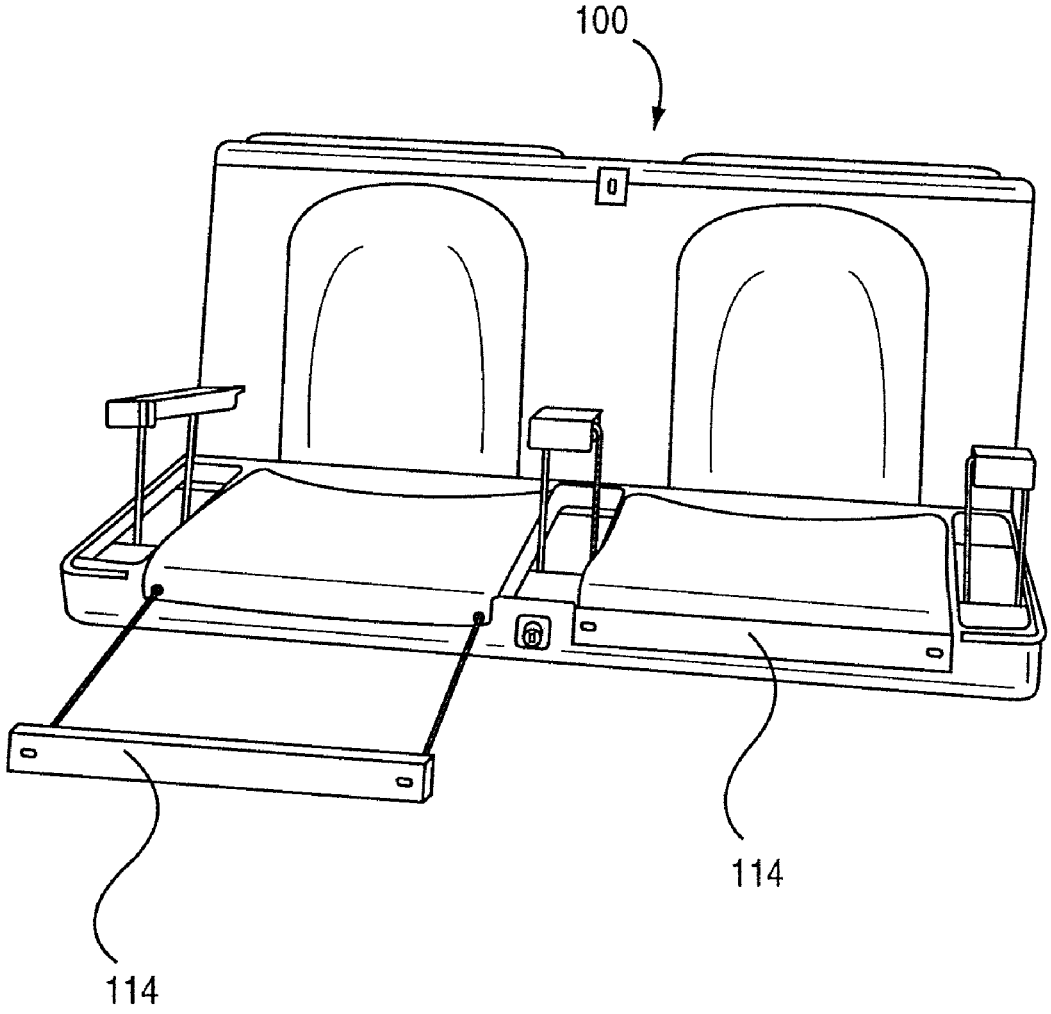

FIG. 11*f* is a perspective view of cooler seat 100 in the opened position. As can be seen, by the provision of the offset portion of the bottom, the seats are semi-reclined in the open position. FIG. 11*g* shows an embodiment of retractable cup holders 130. FIG. 11*h* shows one of the foot rests 114 in the extended position.

Figure 11I:
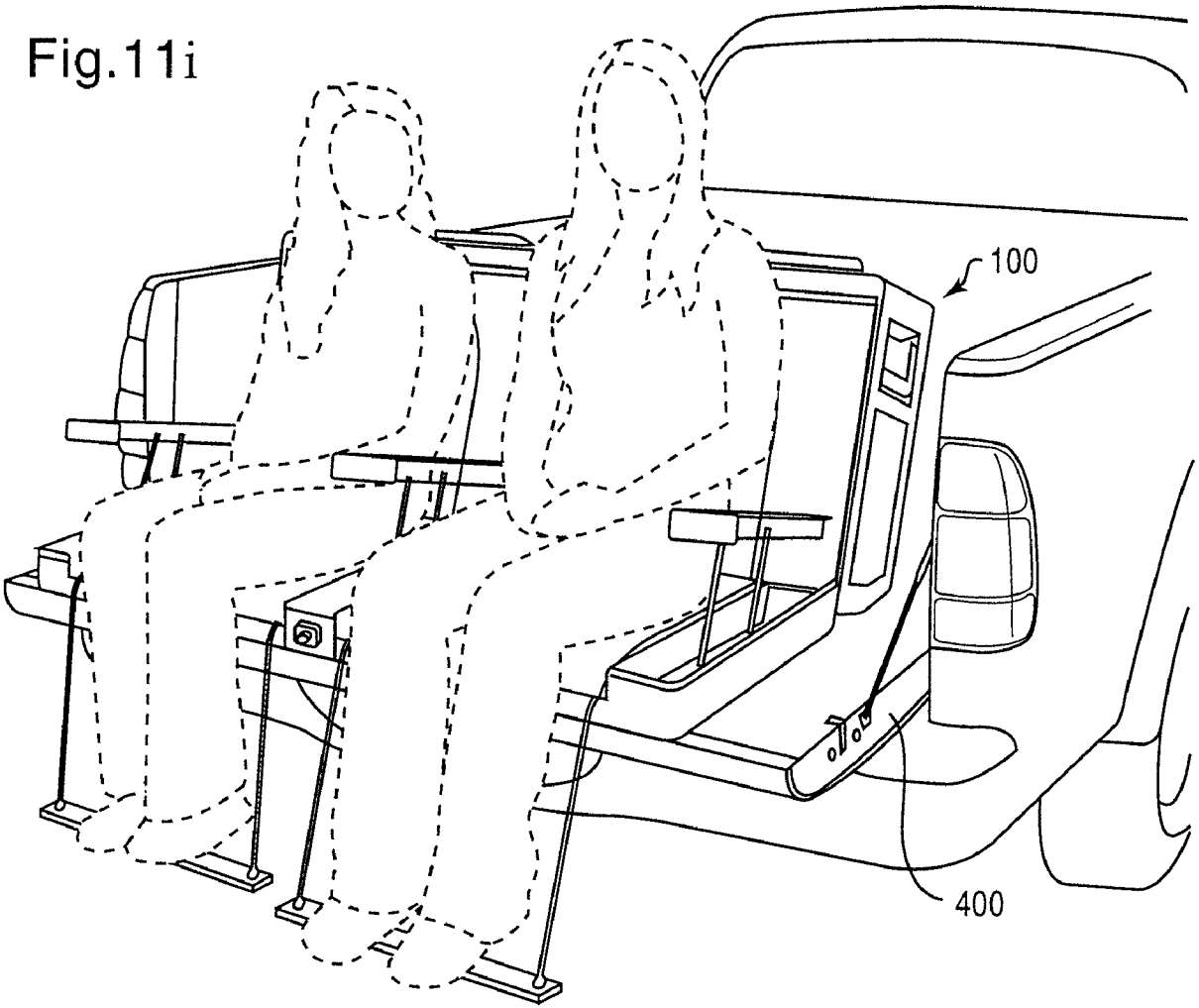

FIG. 11*i* shows two people enjoying the cooler seat 100 while it is secured to the tailgate 400 of a truck.

Thus, a number of preferred embodiments have been fully described above with reference to the drawing figures. Although the invention has been described based upon these preferred embodiments, it would be apparent to those of skill in the art that certain modifications, variations, and alternative constructions could be made to the described embodiments within the spirit and scope of the invention.

For example, the cooler seat could be configured to include only a single seat, or to have three or more seats. Accordingly, the number of compartments might be varied. Further, access to the compartments need not be limited to the top of the cooler, as is traditionally done. Other ways of accessing the compartments are contemplated, for example, from the front or sides for the cooler body.

Also, the cup holders need not be disposed on the arm rests and could be disposed in the seat assembly frame wherever convenient. For example, cup holders could be provided at points below the arm rests in the recessed areas of the seat bottom assembly.

We claim:

1. A cooler having an integral seat applicable to a vehicle, comprising:

a hollow cooler body having one or more insulated interior cooler compartments and one or more cooler compartment lids hingedly coupled with said hollow cooler body to provide sealable access to each of said interior insulated cooler compartments, an outer wall of said cooler body forming a seat back; and a seat bottom assembly coupled with said cooler body such that said outer wall of said cooler body and said seat bottom assembly form a seat when said seat bottom assembly is in an open position, said seat bottom assembly being foldable to a closed position such that said seat bottom assembly is substantially parallel to said outer wall of said cooler body in said closed position;

wherein the hollow cooler body further comprises a bottom surface that includes an offset surface portion forming an obtuse angle with the bottom surface, such that the hollow cooler body, when resting on the offset surface, forms an obtuse angle with the seat bottom assembly when said seat bottom assembly is in the open position.

2. The cooler recited in claim 1, wherein said one or more interior insulated cooler compartments are removable from said hollow cooler body.

3. The cooler recited in claim 1, wherein said seat bottom assembly includes one or more seat bottoms and said outer wall includes one or more integral contoured seatbacks corresponding to the one or more seat bottoms.

4. The cooler recited in claim 3, wherein said seat bottom assembly includes one or more retractable footrests corresponding to the one or more seat bottoms.

5. The cooler recited in claim 1, wherein said seat bottom assembly is lockable in said closed position.

6. The cooler recited in claim 1, wherein said seat bottom assembly includes an assembly bottom supporting seat bottoms and arm rests, and when said seat bottom assembly is in the closed position, only said assembly bottom is visible.

7. The cooler recited in claim 6, wherein said arm rests each include a cup holder.

8. The cooler recited in claim 1, further comprising a locking assembly coupled with at least one of said cooler body and said seat assembly, and is configured to attach to a vehicle.

9. The cooler recited in claim 8, wherein said lock assembly includes an attachment part, and a lock cover, said attachment part for connecting said cooler to a truck tailgate and including means for allowing a lock to secure said attachment part, said lock cover preventing access to said lock from above said tailgate.

10. The cooler recited in claim 1, wherein said offset surface portion has a surface area smaller than a remainder of said bottom surface.

11. The cooler recited in claim 1, further comprising a lockable storage compartment separate from said cooler compartments.

12. The cooler as recited in claim 1, wherein said cooler body and said seat bottom assembly are coupled by one or more hinges.

13. The cooler as recited in claim 1, wherein said outer wall of said cooler body acts as a seat back when said seat assembly is in said open position.

14. The cooler as recited in claim 1, wherein said outer wall of said cooler body includes one or more seat backs integral with said outer wall.

15. The cooler as recited in claim 14, wherein said integral seatbacks are molded into said outer wall.

16. A cooler having an integral seat applicable to a vehicle, comprising:

storage means for providing closable insulated storage, said storage means including an outer wall comprising seat back means; and foldable seating means coupled with said storage means for providing seating areas such that said outer wall of said storage means acts as a seatback when said foldable seating means is in an open position, said foldable seating means being foldable to a closed position;

wherein said storage means further comprises an outer cooler body having a bottom surface that includes an offset surface portion forming an obtuse angle with the bottom surface, such that the cooler body, when resting on the offset surface, forms an obtuse angle with the seat bottom assembly when said foldable seating means is in the open position.

17. The cooler recited in claim 16, wherein said storage means includes one or more removable interior insulated cooler compartments.

18. The cooler recited in claim 17, wherein said seating areas includes one or more seat bottoms and an outer wall of said storage means includes one or more contoured seatbacks corresponding to the one or more seat bottoms.

19. The cooler recited in claim 18, wherein said foldable seating means includes one or more retractable footrests corresponding to the one or more seat bottoms.

20. The cooler recited in claim 16, wherein said foldable seating means is lockable in a closed position.

21. The cooler recited in claim 16, wherein said foldable seating means includes an assembly bottom supporting seat bottoms and retractable arm rests between each seat bottom, and when said foldable seating means is in the closed position, only said assembly bottom is exposed.

22. The cooler recited in claim 21, wherein said arm rests each include a cup holder.

23. The cooler recited in claim 16, further comprising a locking means for lockably securing said cooler to a vehicle.

24. The cooler recited in claim 23, wherein said locking means includes an attachment part, and a lock cover, said attachment part for connecting said cooler to a truck tailgate and including means for allowing a lock to secure said attachment part, said lock cover preventing access to said lock from above said tailgate.

25. The cooler recited in claim 16, wherein said offset surface portion has a surface area smaller than a remainder of said bottom surface.

26. The cooler recited in claim 16, wherein said storage means further comprises a lockable storage compartment separate from interior cooler compartments.

* * * * *